US005078580A

United States Patent [19]

Miller et al.

[11] Patent Number: 5,078,580

[45] Date of Patent: Jan. 7, 1992

[54] PLURAL-STAGE GAS COMPRESSOR

[75] Inventors: Bernard F. Miller, Corning, N.Y.; John A. Sawyer, Trout Run, Pa.

[73] Assignee: Dresser-Rand Company, Corning, N.Y.

[21] Appl. No.: 677,058

[22] Filed: Mar. 29, 1991

[51] Int. Cl.[5] ..... F04B 1/00; F04B 21/08

[52] U.S. Cl. ..... 417/265; 92/128; 92/171.1; 417/454; 417/539

[58] Field of Search ..... 417/254, 265, 266, 539, 417/454, 490, 571; 92/128, 147, 73, 171.1

[56] References Cited

U.S. PATENT DOCUMENTS 1,883,328 10/1932 Bihl et al. ..... 417/490
2,059,758 11/1936 Stearns ..... 92/147 X
2,325,672 8/1943 Groff ..... 417/454
2,727,466 12/1955 Kling et al. ..... 92/128 X
3,426,696 2/1969 Poynter ..... 417/539 X
3,472,171 10/1969 Sadler ..... 92/171.1 X
4,032,263 6/1977 Pareja ..... 417/539
4,242,063 12/1980 Pareja ..... 417/454

*Primary Examiner*—Leonard E. Smith
*Attorney, Agent, or Firm*—Bernard J. Murphy

[57] ABSTRACT

The compressor, of the reciprocating-piston type is actuated by a camshaft confined in a small, compact frame. Cams translate cross-heads which are slidably guided within the frame, and which are threadedly coupled to depending stubs of the pistons. A bolted-on head plate confines valving components atop cylinders set within the frame, and the head plate has passageways formed internally to conduct the gas to and from successive stages of compression.

17 Claims, 6 Drawing Sheets 3
3
10
12
14
16
18
20
22
24
26
28
30
32
34
36
38
40
42
44
46
48
50
52
54
56
58
60
62
64
66
68
70
72
74
76
78
80
82
84
86
88
90
92
94
96
98
100
102
104
106
108
110
114
118
120
122
124
126
127
128

PLURAL-STAGE GAS COMPRESSOR

This invention pertains to reciprocating gas compressors, and in particular to a novel gas compressor of the aforesaid type of small, compact design which will compress gas, at a relative small flow of approximately a half a cubic foot a minute, but at approximately three thousand pounds per square inch, the compressor further being of light weight. Too, the invention particularly concerns a gas compressor comprising the aforesaid capability which further has few reciprocating components and is singularly constructed to accommodate facile maintenance thereof.

It is an object of this invention, then, to set forth just such a compact, light and efficient gas compressor of plural stages.

Especially is it an object of this invention to disclose a plural-stage gas compressor comprising a frame; said frame having a throughgoing bore formed therein, and a plurality of separate, parallel channels formed therein which open onto said bore and externally onto an outer surface of said frame; a camshaft rotatably journalled in said bore; a piston cylinder in each of said channels; and a piston in each of said cylinders; wherein said camshaft has a plurality of cams thereon; and further including first means interposed between said camshaft and said pistons for causing said cams of said camshaft to translate said pistons, cyclically, in a first reciprocable direction; second means interposed between said cylinders and said camshaft for causing said pistons to translate, cyclically, in a second reciprocable direction; a head plate fixed upon said outer surface of said frame in closure of said channels; inlet and discharge valving interposed between each of said cylinders and said head plate; and passageways formed in said head plate communicating between said valving; and wherein said head plate has two ports formed therein for admitting and discharging gas thereinto and therefrom, which ports open onto said passageways and externally of said head plate, respectively.

Further objects of this invention, as well as the novel features thereof, will become more apparent by reference to the following description, taken in conjunction with the accompanying figures, in which.

Figure 1:
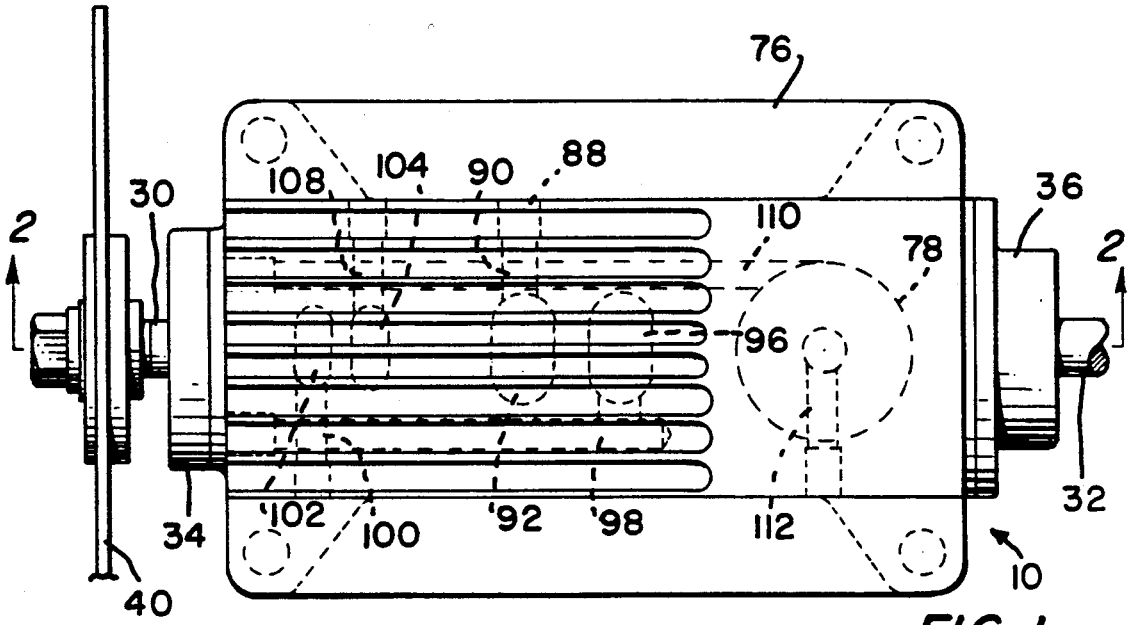
FIG. 1 is a top or plan view of the novel compressor according to an embodiment thereof.
Figure 3:
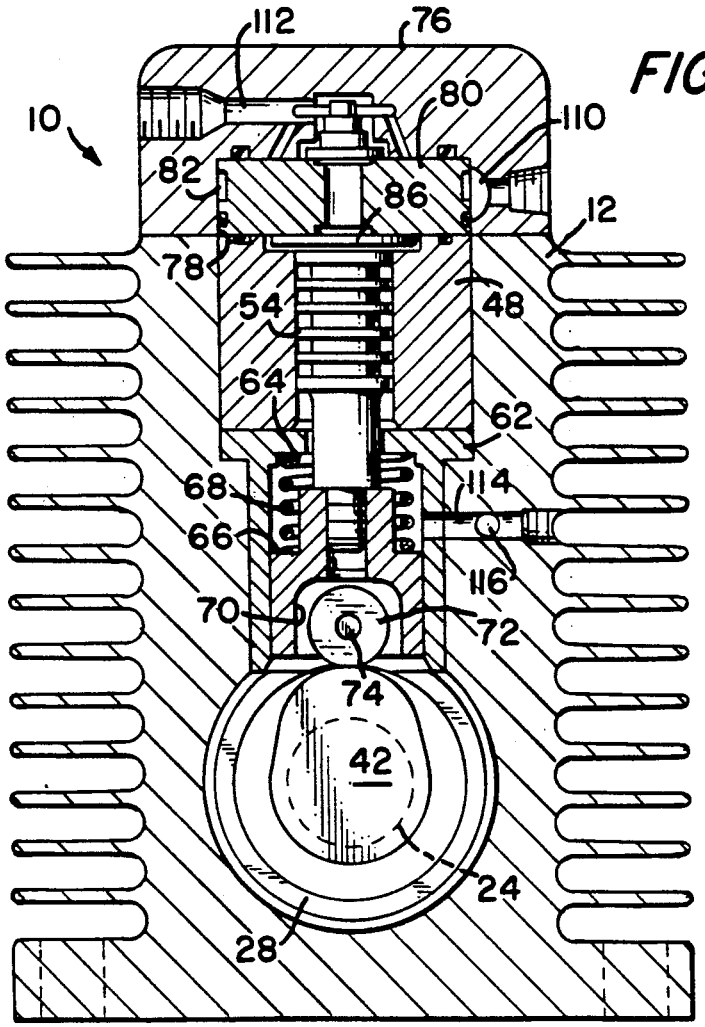
FIG. 3 is a cross-sectional view taken along section 3—3 of FIG. 2 in which some details of the porting in the valve body are not shown.
Figure 2:
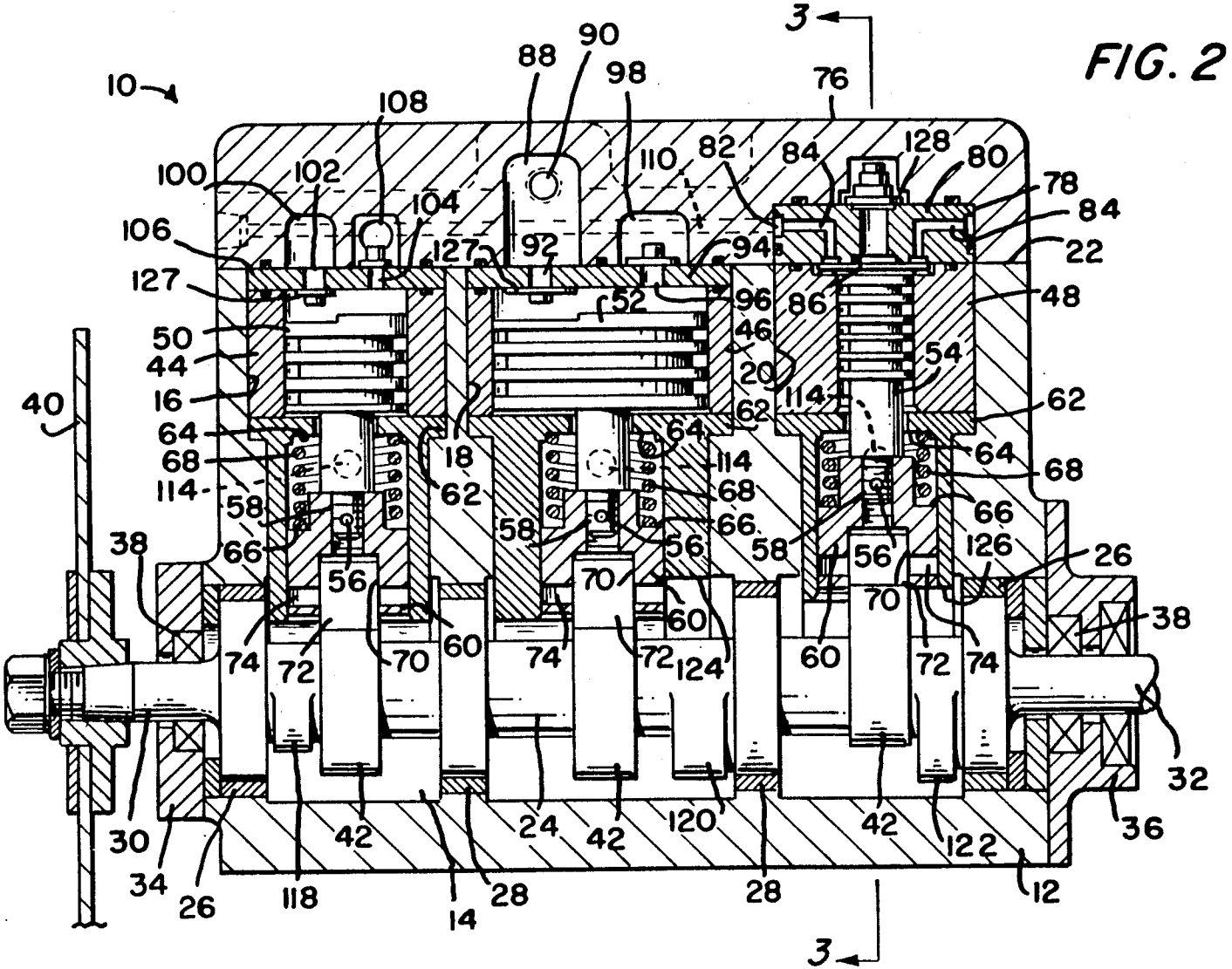
FIG. 2 is a cross-sectional view taken along section 2—2 of FIG. 1.

As shown in FIGS. 1-5, a plural-stage gas compressor 10, according to a first embodiment of the invention, comprises a frame 12 which has a longitudinal, throughgoing bore 14 formed therein, and three separate, parallel channels 16, 18 and 20 formed therein. The channels 16, 18 and 20 each open onto the bore 14 and onto an outer, top surface 22 of the frame 12. A camshaft 24 is rotatably journalled, on bearings 26 and 28, in the bore 14. Opposite ends 30 and 32 of the camshaft project beyond the frame 12, through end covers 34 and 36 which are apertured to accommodate the shaft ends 30 and 32. Seals 38, set within the covers 34 and 36 sealing confine lubricating oil within the bore 14. Drain ports (not shown) provide for an exit of oil from the frame 12. End 32 of the camshaft 24 is configured to receive a driving prime mover (not shown), and end 30 mounts a cooling fan 40. The camshaft 24 has three cams 42 formed thereon which rotate in alignment with the centerlines of the channels 16, 18 and 20.

Secured within the channels 16, 18 and 20 are piston cylinders 44, 46 and 48, and each has a piston 50, 52 and 54, respectively, therewithin. The lowermost end of each piston has a depending, threaded stub 56. The stubs are received in correspondingly threaded bores 58 which are formed in uppermost portions of crossheads 60. The crossheads 60 are slidably guided, within the channels 16, 18 and 20, by guides 62. The guides 62 are set immediately below the cylinders 44, 46 and 48. Each guide 62 has an underlying, radial land 64. Too, each crosshead 60 has a radial land 66. Compression springs 68, set circumjacent the crossheads 60, and between the lands 64 and 66, bias the pistons 50, 52 and 54 in a downward (with reference to FIG. 2) direction. Each crosshead 60 has a recess 70 formed therein which mounts a roller 72 by means of pins 74. With rotation of the camshaft 24, then, the cams 42 force the rollers 72, which function as cam followers, upwardly, against the bias of the springs 68, carrying the crossheads 60 and the pistons 50, 52 and 54 therebefore.

Fixed to the top surface 22 of the frame 12 is a head plate 76. Plate 76 has a circular relief 78 formed in an underlying surface thereof in which it nests a valve body 80. Body 80 has a circumferential groove 82 which communicates with passageways 84 formed within the body 80. The passageways 84 open onto the surface 22 where they confront a flapper-type valving element 86 which is captive atop cylinder 48. In this embodiment, cylinder 48 and piston 54 constitute a third stage of compression and, consequently, compressed gas enters therein via passageways, formed in the head plate 76, from the other two stages; of this, more is explained in the ensuing text.

Figure 4:
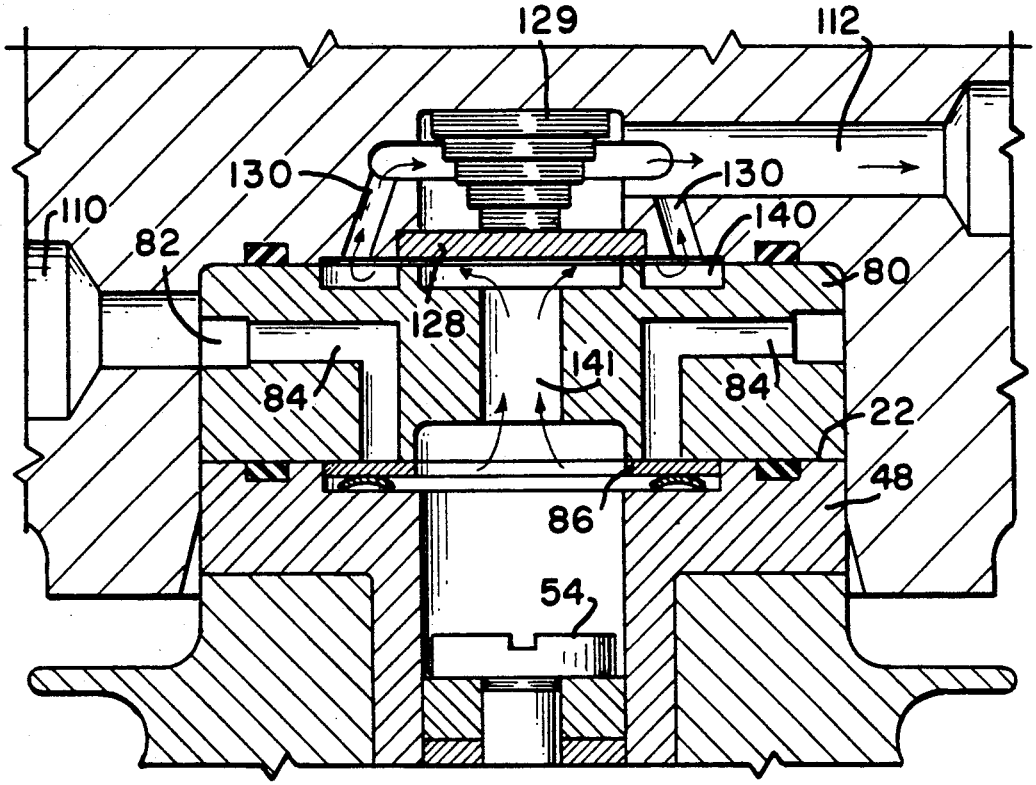
FIG. 4 is an enlarged, cross-sectional view of the last-stage valving, valve body porting, and upper portion of the piston and cylinder thereat, the same showing the inlet (suction) valve closed, and the outlet (discharge) valve open.
Figure 5:
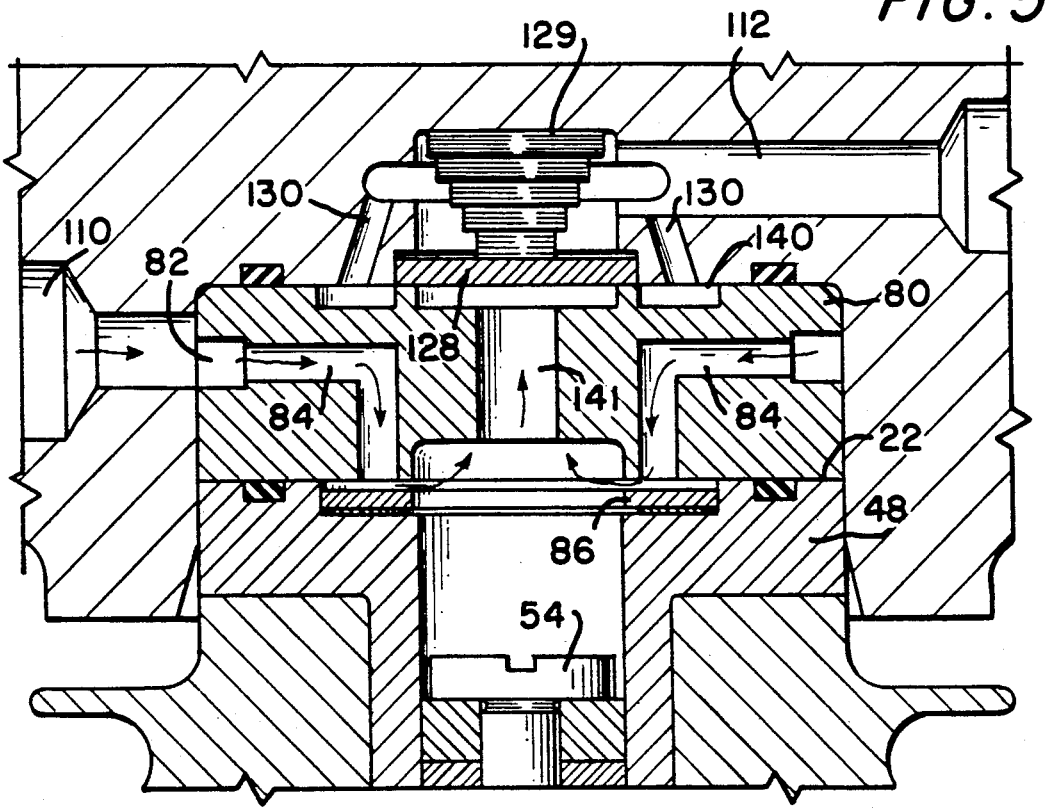
FIG. 5 is a cross-sectional view like that of FIG. 4 showing, however, the inlet and outlet valves open and closed, respectively.

With particular reference to FIGS. 1, 4 and 5, it will be seen that the head plate 76 has a gas inlet port 88 which opens onto a passage way 90; the latter supplies the admitted gas to an inlet port 92 formed in a valve body 94 set upon cylinder 46. Cylinder 46 and piston 52 constitute a first stage of gas compression, in this embodiment of the invention. Valve body 94 has a discharge port 96 formed therein which communicates with a passageway 98. The latter carries the first stage-compressed gas to the second stage cylinder 44 and piston 50. Here, the gas enters via a passageway 100 which communicates with an inlet port 102. In turn, further compressed gas leaves cylinder 44 via a discharge port 104. Ports 102 and 104 are formed in a valve body 106 which, like body 94, is set upon its respective cylinder, namely, cylinder 44. Valve bodies 94 and 106 have displaceable valving elements 127, of the reed type, which, with compression and vacuum strokes of the associated pistons 50 and 52, open and close, responsively, as is conventional in the prior art.

Discharge port 104 communicates with a passageway 108 and, in turn, passageway 108 opens onto another passageway 110, also formed in the head plate 76, which terminates at, and into, the circumferential groove 82 of valve body 80. Finally, the thrice-compressed gas exits from cylinder 48 via a final discharge port 112. With reference to FIG. 5, the inlet compressed gas for valve body 80 passes from groove 82 into ports 84, and thence over "open" element 86, to a center port 141, for final-stage compression thereof in cylinder 48. Following such final compression, the gas exits via the center port 141, across open valving element 128 which is opened against the bias of spring 129, into an annular channel 140 formed in body 80, through ports 130 and out through passage way 112. Each crosshead guide 62 has a vent hole 114 formed therein which communicates with a through-frame channel 116. Thus the vent holes are manifolded, and return the vented gas to the first stage cylinder 46; alternatively, the vented gas could be otherwise conducted away.

For purposes of balance, the camshaft 24 has integral counterweights 118, 120 and 122. To accommodate for the rotary sweep of the counterweights 120 and 122, the crosshead guides 62, which are thereabove, have reliefs 124 and 126 formed in lowermost portions thereof and to one side of each.

The compressor 10 is unique in its provisioning of compression of gas to a high pressure in a compact, small unit which has very few reciprocating components. As designed, taking advantage of aluminum or non-metallic materials for most of the parts, the compressor can be very light in weight—for example, seven or eight pounds in all. The design provides for a high rotative speed, up to thirty-six hundred r.p.m. The machining required is not complex, and maintenance of the compressor 10 is easily undertaken. Removal of the head plate 76 provides access to, and permits removal of, all the valving elements, the cylinders, pistons, crossheads and crosshead guides. Also, by removing the end covers 34 and 36, following detachment of the fan 40, the camshaft 24 is easily replaceable.

Figure 6:
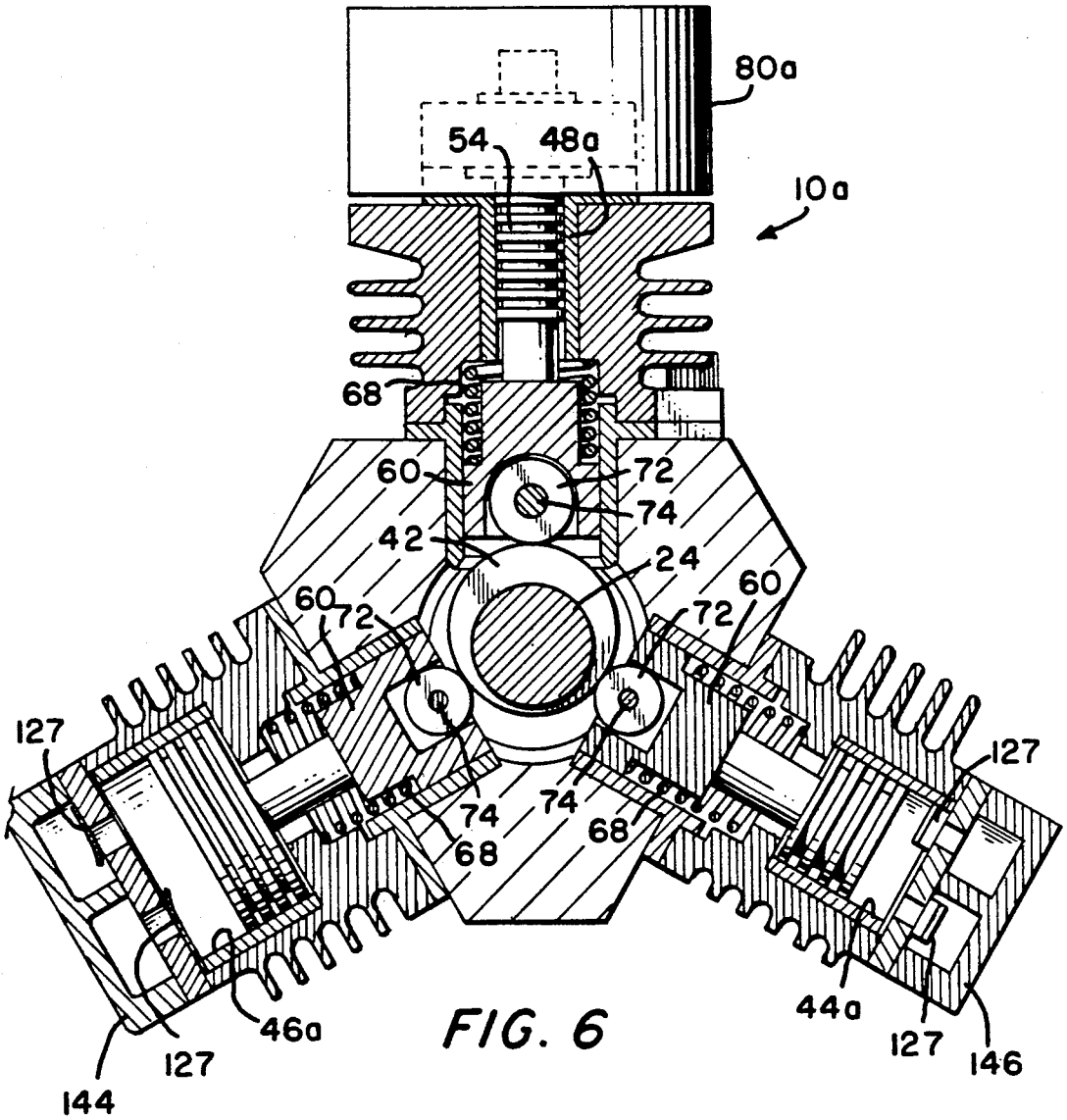
FIG. 6 is a vertical, cross-sectional view of an alternative embodiment of the invention.
Figure 7:
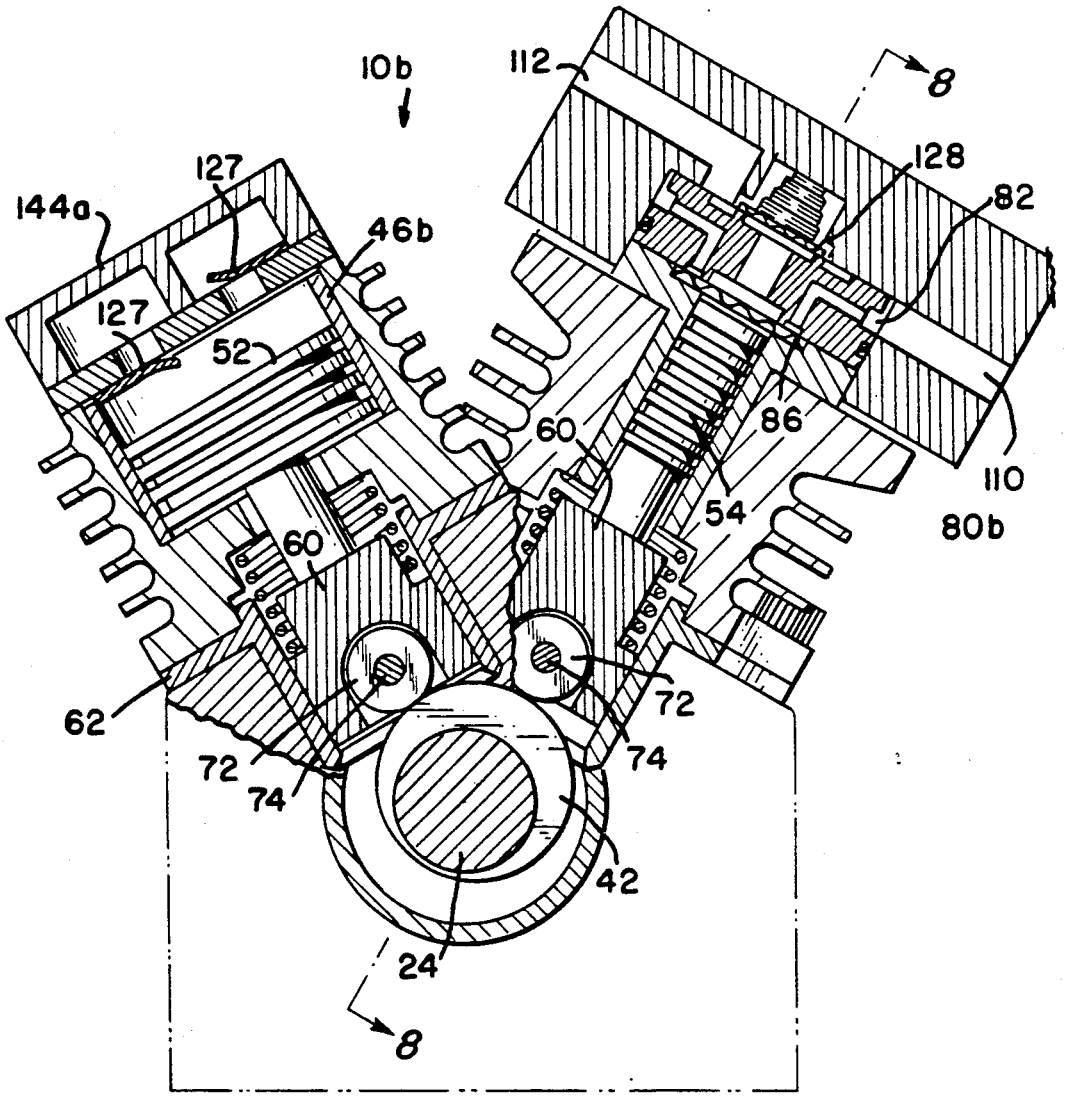
FIG. 7 is a vertical, cross-sectional view of a further, alternative embodiment of the invention.
Figure 8:
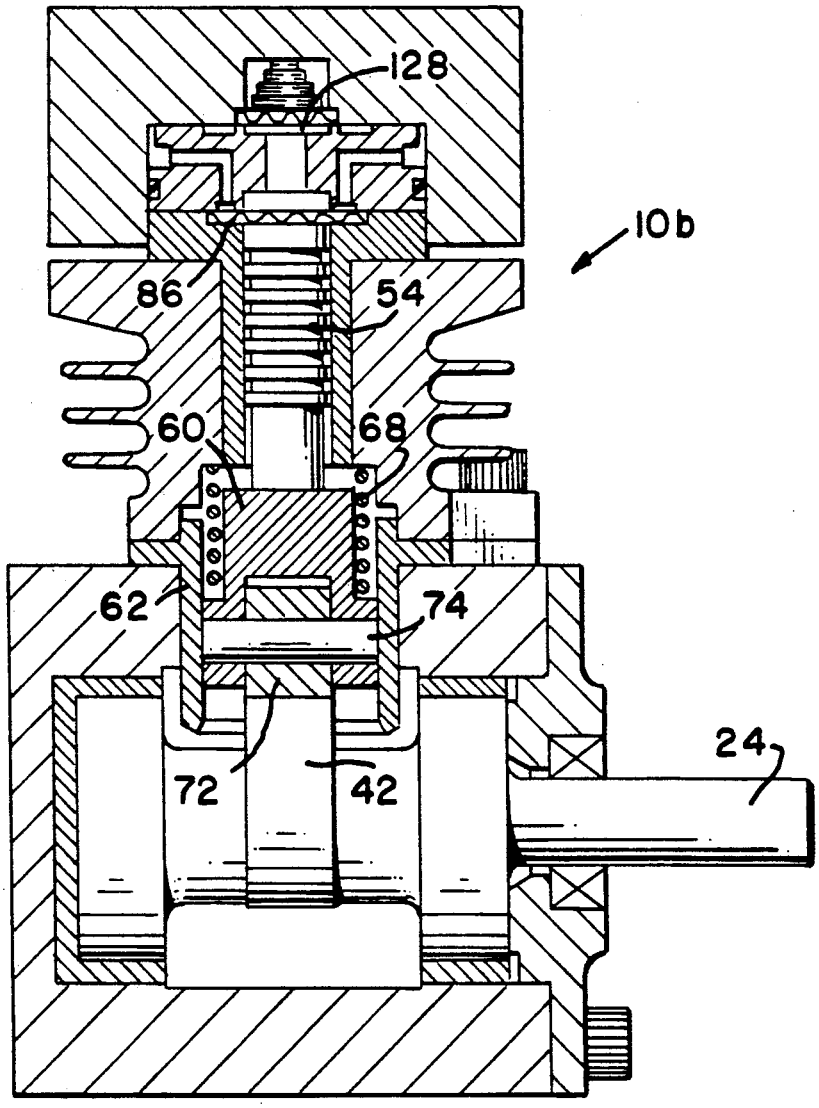
FIG. 8 is a cross-sectional view taken along section 8—8 of FIG. 7.

While the compressor is described as a three-stage machine, the invention is not limited to such a configuration. Using the features of the novel construction, a compressor of two, or four stages can be readily constructed. The bore 14 is formed in a unitized frame 12, however, clearly, the frame could be split at the centerline of the bore 14, and the separable (split) lower portion of such a frame can be bolted to the upper portion; consequently, the lower portion can be removed for inspection of the camshaft and bearings. Too, the invention can be embodied in other than in-line cylinder configurations. Such other configurations are depicted in FIGS. 6 through 8. In FIGS. 6 through 8, same or similar index numbers shall be taken to represent same or similar indexed components and parts as are depicted in FIGS. 1 through 5.

The compressor 10*a* shown in FIG. 6 has a radial-cylinder configuration, in which first, second and third-stage cylinders 46*a*, 44*a*, and 48*a*, respectively, are set one hundred and twenty degrees of arc apart. In lieu of a single head plate, each cylinder is surmounted by valving heads 144, 146 and 80*a*. Heads 144 and 146 confine the reed-type valving elements 127 therein, and head 80*a* corresponds to the valve body 80 of the embodiment of FIGS. 1 through 5.

For compressor 10*a* of FIG. 6, tubing, interconnecting the three stages of gas compression cylinders would be provided. As such is quite within the ken of those of ordinary skill in the relevant technology, depiction thereof is not given.

The compressor 10*b* shown in FIGS. 7 and 8 is of the "Vee" configuration, in which first and second stage cylinders 46*b* and 44*b*, respectively, are in parallel (the second stage structure is hidden behind that of the first stage), and are inclined approximately thirty degrees of arc from vertical. The third stage cylinder 48*b* is also inclined from the vertical, approximately thirty degrees of arc; i.e., approximately sixty degrees of arc are subtended between the axial centerlines of the third stage cylinder 48*b* and the parallel centerlines of the first and second stage cylinders 46*b* and 44*b*. As in the embodiment of FIG. 6, compressor 10*b*, the first and second stage cylinders 46*b* and 44*b* are surmounted by valving heads 144*a* and 146*a*. Too, the third stage cylinder 48*b* is surmounted by a valving head or valving body 80*b*; the latter corresponds to the valve body 80 of the embodiment of FIGS. 1 through 5 and head 80*a* of the FIG. 6 embodiment. The valving heads 144*a* and 146*a* confine the reed-type valving elements therein, and valving body 80*b* has formed therein, generally, the same porting as in valving head 80*a* and valve body 80.

Optionally, of course, cylinders 46*b* and 44*b* can share a common head plate, in lieu of separate valving heads. Too, as with the compressor 10*a* of FIG. 6, the stages of compression would be interconnected with tubing; such is not depicted here also.

While we have described our invention in connection with specific embodiments thereof it is to be clearly understood that this is done only by way of example, and not as a limitation to the scope of our invention as set forth in the objects thereof and in the appended claims.

I claim:

1. A plural-stage gas compressor, comprising:

a frame;

said frame having a throughgoing bore formed therein, and a plurality of separate channels formed therein which open onto said bore and externally onto outer surfaces of said frame;

a camshaft rotatably journalled in said bore;

a piston cylinder in each of said channels; and a piston in each of said cylinders; wherein said camshaft has a plurality of cams thereon; and further including first means interposed between said camshaft and said pistons for causing said cams of said camshaft to translate said pistons, cyclically, in a first reciprocable direction;

second means interposed between said cylinders and said camshaft for causing said pistons to translate, cyclically, in a second reciprocable direction;

head plates fixed upon said outer surfaces of said frame in closure of said channels; and inlet and discharging valving interposed between each of said head plates and said cylinders.

2. A plural-stage gas compressor, according to claim 1, further including:

crossheads removably joined to said pistons; and crosshead guides interposed between said cylinders and said camshaft; wherein said crossheads are slidably engaged with said guides;

each said guide has a radial land;

each said crosshead has a radial land; and said second means comprises compression springs set circumjacent said crossheads, with ends thereof bearing against said lands of said guides and said crossheads.

3. A plural-stage gas compressor, according to claim 14, wherein:

each said crosshead has a threaded bore formed therein; and each said piston has a depending, threaded stub which is threadedly engaged with said threaded bore of an associated crosshead.

4. A plural-stage gas compressor, according to claim 1, wherein:

said first means comprises cam followers.

5. A plural-stage gas compressor, according to claim 4, wherein:

said cam followers are coupled to said crossheads;

said crossheads each have a recess formed therein;

said followers comprise rollers; and said rollers are journalled in said recesses.

6. A plural-stage gas compressor, comprising:

a frame;

said frame having a throughgoing bore formed therein, and a plurality of separate, parallel channels formed therein which open onto said bore and externally onto an outer surface of said frame;

a camshaft rotatably journalled in said bore;

a piston cylinder in each of said channels; and a piston in each of said cylinders; wherein said camshaft has a plurality of cams thereon; and further including first means interposed between said camshaft and said pistons for causing said cams of said camshaft to translate said pistons, cyclically, in a first reciprocable direction;

second means interposed between said cylinders and said camshaft for causing said pistons to translate, cyclically, in a second reciprocable direction;

a head plate fixed upon said outer surface of said frame in closure of said channels;

inlet and discharge valving interposed between each of said cylinders and said head plate; and passageways formed in said head plate communicating between said valving; and wherein said head plate has two ports, for admitting and discharging gas thereinto and therefrom, which open onto said passageways and externally of said head plate, respectively.

7. A plural-stage gas compressor, according to claim 6, wherein:

said first means comprises cam followers.

8. A plural-stage gas compressor, according to claim 6, further including:

crossheads removably joined to said pistons; and said first means comprises cam followers coupled to said crossheads.

9. A plural-stage gas compressor, according to claim 8, wherein:

said crossheads each have a recess formed therein;

said followers are rollers; and said rollers are journalled in said recesses.

10. A plural-stage gas compressor, according to claim 6, wherein:

said camshaft has first and second ends which project outwardly from said frame; and further including a pair of apertured end covers fixed to said frame, at ends of said bore, to close off said bore, and said ends of said camshaft extend through apertures in said covers.

11. A plural-stage gas compressor, according to claim 10, further including:

a cooling fan removably coupled to one of said ends of said camshaft.

12. A plural-stage gas compressor, according to claim 6, further including:

crossheads removably joined to said pistons; and crosshead guides interposed between said cylinders and said camshaft; wherein said crossheads are slidably engaged with said guides;

each said guide has a radial land;

each said crosshead has a radial land; and said second means comprises compression springs set circumjacent said said crossheads with ends thereof bearing against said lands of said guides and said crossheads.

13. A plural-stage gas compressor, according to claim 12, wherein:

said guides are cylindrical having circumferential walls; and further including vent holes formed in said walls; and a passageway, formed in said frame, in open communication with each of said vent holes.

14. A plural-stage gas compressor, according to claim 12, wherein:

each said crosshead has a threaded bore formed therein; and each said piston has a depending, threaded stub which is threadedly engaged with said threaded bore of an associated crosshead.

15. A plural-stage gas compressor, according to claim 6, wherein:

said frame has a base, and an opposite top;

said outer surface comprises said top; and upon removal of said head plate from said top, all said valving, cylinders, and pistons are removable from said frame through said top.

16. A plural-stage gas compressor, according to claim 15, wherein:

each said piston has a crosshead joined thereto removably; and further including crosshead guides interposed between said cylinders and said camshaft; wherein said crossheads are slidably engaged with said guides; and said crossheads and said guides are also removable from said frame, through said top, upon removal of said head plate from said top.

17. A plural-stage gas compressor, according to claim 16, wherein:

said camshaft has a plurality of counterweights integrally carried thereon;

each said crosshead guide has an end which confronts said camshaft; and a plurality of said guides have reliefs formed in said camshaft-confronting ends thereof to accommodate said counterweights.

* * * * *

UNITED STATES PATENT AND TRADEMARK OFFICE

CERTIFICATE OF CORRECTION

PATENT NO. : 5,078,580

DATED : Jan. 7, 1992

INVENTOR(S) : Bernard F. Miller and John A. Sawyer

It is certified that error appears in the above—identified patent and that said Letters Patent is hereby corrected as shown below:

Column 5, line 6, change "14" to - - 2 - - ; and

Column 5, line 13, change "1" to - - 2 - - .

Signed and Sealed this

Eleventh Day of May, 1993

*Attest:*

Michael K. Kirk

MICHAEL K. KIRK

*Attesting Officer*

*Acting Commissioner of Patents and Trademarks*